US010984751B2

(12) United States Patent
Peana et al.

(10) Patent No.: US 10,984,751 B2
(45) Date of Patent: Apr. 20, 2021

(54) BLUE-LIGHT ENERGY MITIGATION OF AN INFORMATION HANDLING SYSTEM

(71) Applicant: Dell Products L.P., Round Rock, TX (US)

(72) Inventors: Stefan Peana, Austin, TX (US); Deeder M. Aurongzeb, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 16/556,945

(22) Filed: Aug. 30, 2019

(65) Prior Publication Data

US 2021/0065654 A1 Mar. 4, 2021

(51) Int. Cl.
*G09G 5/10* (2006.01)

(52) U.S. Cl.
CPC ..... *G09G 5/10* (2013.01); *G09G 2320/0626* (2013.01); *G09G 2330/027* (2013.01); *G09G 2354/00* (2013.01); *G09G 2360/144* (2013.01); *G09G 2360/145* (2013.01)

(58) Field of Classification Search
None
See application file for complete search history.

(56) References Cited

U.S. PATENT DOCUMENTS

| | | | | |
|---|---|---|---|---|
| 8,638,288 | B2 * | 1/2014 | Taylor | G09G 3/342 345/102 |
| 8,791,642 | B2 * | 7/2014 | van de Ven | H05B 45/44 315/192 |
| 8,847,874 | B2 * | 9/2014 | Price | H05B 45/37 345/102 |
| 2020/0051489 | A1 * | 2/2020 | Peana | H01L 25/0753 |

* cited by examiner

*Primary Examiner* — Van N Chow
(74) *Attorney, Agent, or Firm* — Baker Botts L.L.P.

(57) ABSTRACT

Method and system for providing, for display on a display device of an information handling system (IHS), one or more images; generating, by a blue-light mitigation computing module, a model of blue-light energy exposure based on the i) the blue-light energy output level of each image, ii) the environmental illumination brightness level, iii) the environmental illumination white color point, iv) the distance of the user, and v) the user exposure time; determining, by the blue-light mitigation computing module and based on the model, that a current blue-light energy exposure of the user with respect to the display device is above a threshold; and in response to determining that the current blue-light energy exposure of the user with respect to the display device is above the threshold, performing, by the blue-light mitigation computing module, an action to mitigate the blue-light energy exposure of the user.

20 Claims, 3 Drawing Sheets

BLUE-LIGHT ENERGY MITIGATION OF AN INFORMATION HANDLING SYSTEM

BACKGROUND

Field of the Disclosure

The disclosure relates generally to information handling systems, and in particular, blue-light energy mitigation of display devices of information handling systems.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Recent research in lighting technology shows that exposure to blue-light energy can be toxic, and such exposure over prolong periods can lead to macular degeneration. Some software solutions can offer the user the opportunity to turn down the brightness of the screen and shift the white point such that it will reduce the blue light energy output.

SUMMARY

Innovative aspects of the subject matter described in this specification may be embodied in methods including providing, for display on a display device of an information handling system (IHS), one or more images; determining, for each image of the one or more images, a blue-light energy output level of the image; determining an environmental illumination brightness level of an environment surrounding the IHS; determining an environmental illumination white color point of the environment surrounding the IHS; determining a distance of a user of the IHS with respect to the display device of the IHS; determining an user exposure time to the blue-light energy output from the IHS; generating, by a blue-light mitigation computing module, a model of blue-light energy exposure based on the i) the blue-light energy output level of each image, ii) the environmental illumination brightness level, iii) the environmental illumination white color point, iv) the distance of the user, and v) the user exposure time; determining, by the blue-light mitigation computing module and based on the model, that a current blue-light energy exposure of the user with respect to the display device is above a threshold; and in response to determining that the current blue-light energy exposure of the user with respect to the display device is above the threshold, performing, by the blue-light mitigation computing module, an action to mitigate the blue-light energy exposure of the user.

Other embodiments of these aspects include corresponding systems and apparatus.

These and other embodiments may each optionally include one or more of the following features. For instance, wherein determining, for each image of the one or more images, the blue-light energy output level of the image includes utilizing a linear histogram to determine the blue-light energy output level of each image of the one or more images. Adjusting a display brightness level of the display device based on the environmental illumination brightness level. Adjusting the display brightness level of the display device further includes adjusting the display brightness level of the display device to match the environment illumination brightness level. Adjusting a white color point of the display device based on the environmental illumination white color point. Adjusting the white color point of the display device further includes adjusting the white color point of the display device to match the environmental illumination white color point. Performing the action to mitigate the blue-light energy exposure of the user includes providing a notification to the user via the display device of the blue-light energy exposure. Performing the action to mitigate the blue-light energy exposure of the user includes i) reducing a display brightness level of the display device and ii) reducing a white color point of the display device. Performing the action to mitigate the blue-light energy exposure of the user includes performing a shut-down operation of the IHS.

Innovative aspects of the subject matter described in this specification may be embodied in a system including a display device providing for display one or more images; an environmental sensor to determine the environmental illumination brightness level of an environment surrounding the IHS, and the environmental illumination white color point of the environment surrounding the IHS; a camera module to determine a distance of a user of the IHS with respect to the display device of the IHS; a blue-light mitigation computing module configured to: determine, for each image of the one or more images, a blue-light energy output level of the image; determine an user exposure time to the blue-light energy output from the IHS; generate a model of a blue-light energy exposure based on the i) the blue-light energy output level of each image, ii) the environmental illumination brightness level, iii) the environmental illumination white color point, iv) the distance of the user, and v) the user exposure time; determine, based on the model, that a current blue-light energy exposure of the user with respect to the display device is above a threshold; and in response to determining that the current blue-light energy exposure of the user with respect to the display device is above the threshold, perform an action to mitigate the blue-light energy exposure of the user.

Other embodiments of these aspects include corresponding methods and apparatus.

These and other embodiments may each optionally include one or more of the following features. For instance, determining, for each image of the one or more images, the blue-light energy output level of the image includes utilizing a linear histogram to determine the blue-light energy output level of each image of the one or more images. Adjusting a display brightness level of the display device based on the environmental illumination brightness level. Adjusting the display brightness level of the display device further includes adjusting the display brightness level of the display device to match the environment illumination brightness level. Adjusting a white color point of the display device based on the environmental illumination white color point. Adjusting the white color point of the display device further includes adjusting the white color point of the display device to match the environmental illumination white color point. Performing the action to mitigate the blue-light energy exposure of the user includes providing a notification to the user via the display device of the blue-light energy exposure. Performing the action to mitigate the blue-light energy exposure of the user includes i) reducing a display brightness level of the display device and ii) reducing a white color point of the display device. Performing the action to mitigate the blue-light energy exposure of the user includes performing a shut-down operation of the IHS.

The details of one or more embodiments of the subject matter described in this specification are set forth in the accompanying drawings and the description below. Other potential features, aspects, and advantages of the subject matter will become apparent from the description, the drawings, and the claims.

DESCRIPTION OF PARTICULAR EMBODIMENT(S)

This document describes a system and a method for providing a contextual model that can process a variety of inputs to determine a viewer's exposure to blue-light energy emission from a display screen. In particular, the contextual model can be a qualitive model of energy accumulation, and based on certain criteria or thresholds, one or more actions can be taken to mitigation the blue-light energy exposure to the user.

In the following description, details are set forth by way of example to facilitate discussion of the disclosed subject matter. It should be apparent to a person of ordinary skill in the field, however, that the disclosed embodiments are exemplary and not exhaustive of all possible embodiments.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include an instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory (SSD); as well as communications media such wires, optical fibers, microwaves, radio waves, and other electromagnetic and/or optical carriers; and/or any combination of the foregoing.

Figure 1:
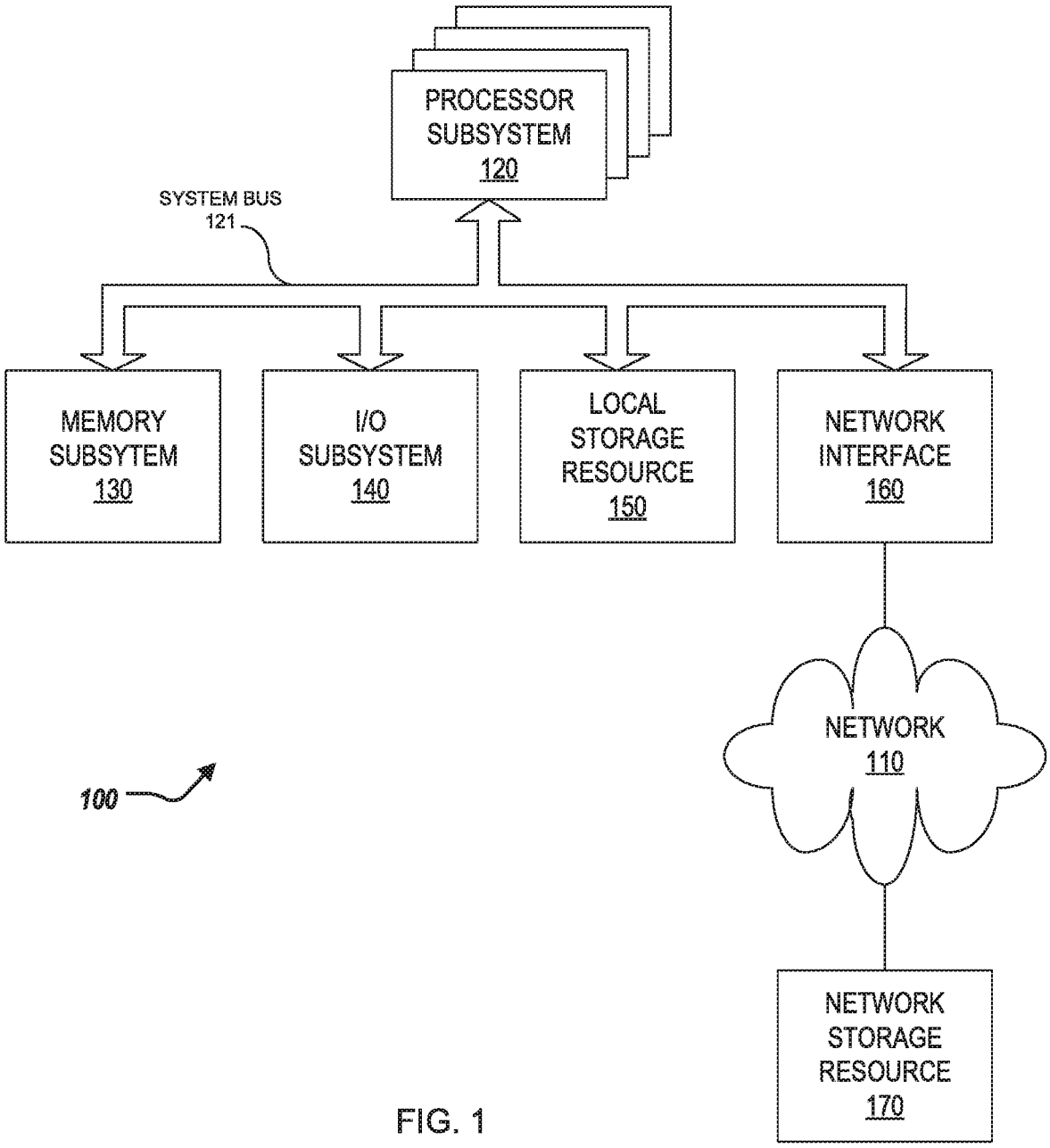
FIG. 1 is a block diagram of selected elements of an embodiment of an information handling system.
Figure 2:
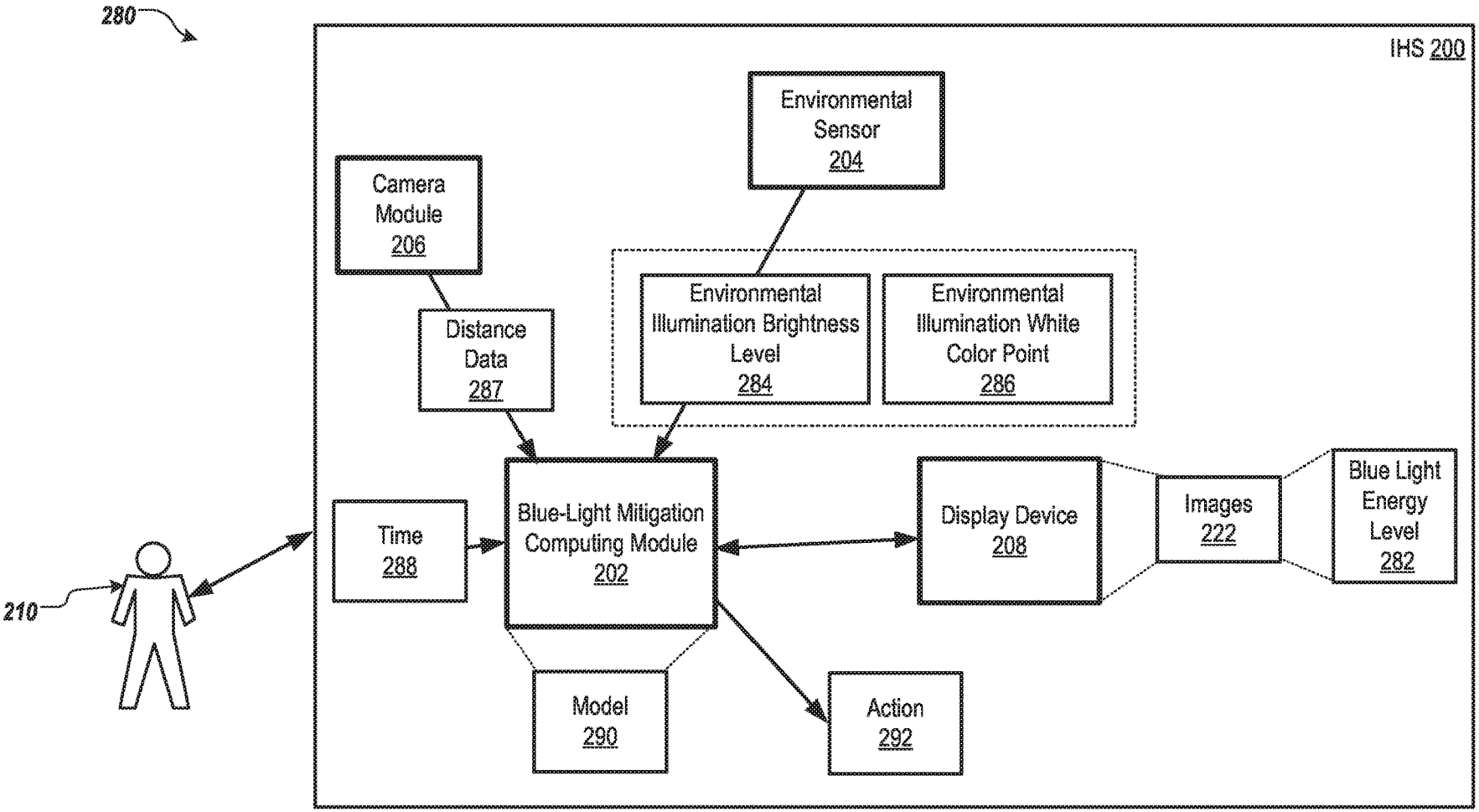
FIG. 2 is a block diagram of an information handling system for mitigating blue-light exposure to a user.
Figure 3:
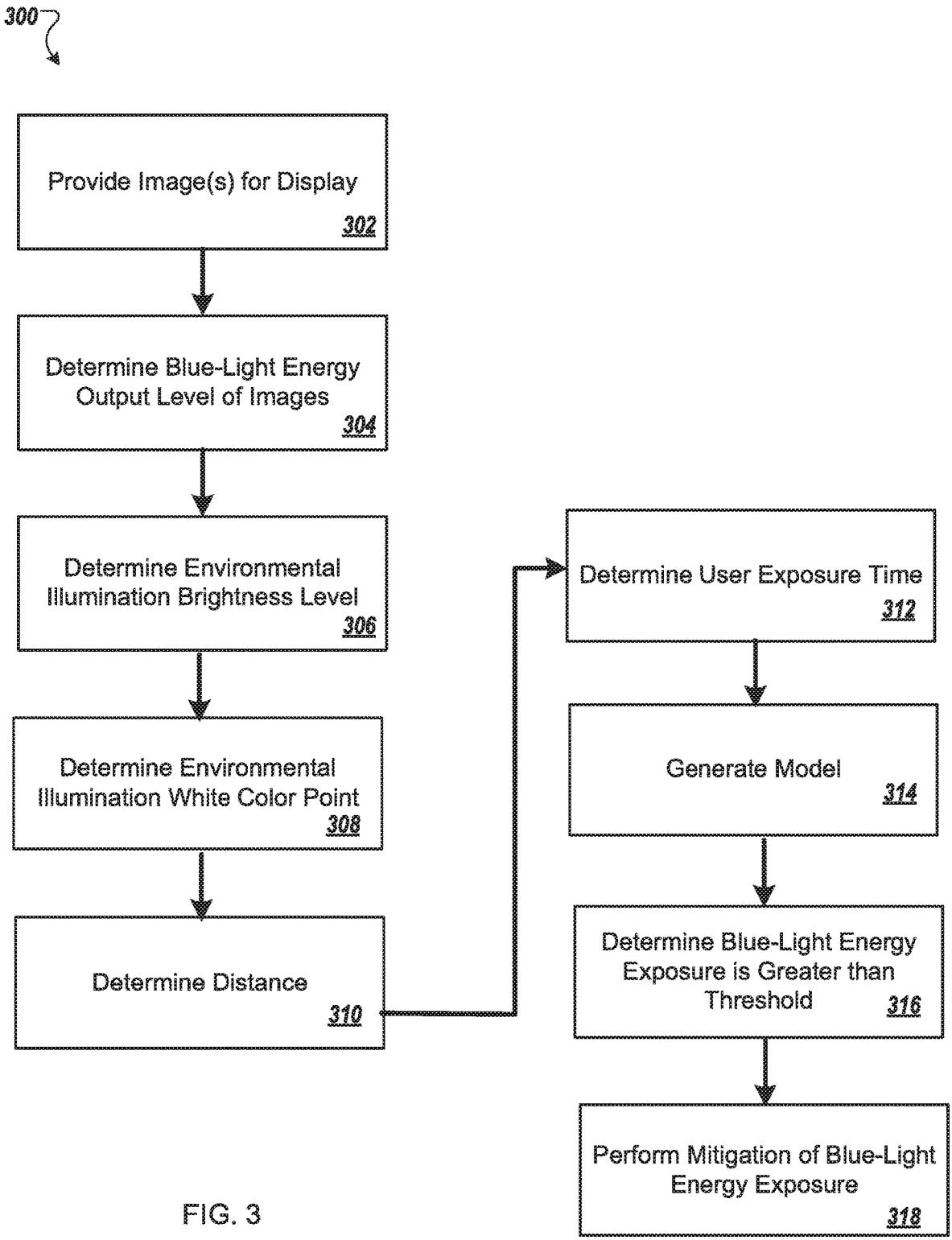
FIG. 3 illustrates a flowchart for mitigating blue-light exposure to a user.

Particular embodiments are best understood by reference to FIGS. 1-3 wherein like numbers are used to indicate like and corresponding parts.

Turning now to the drawings, FIG. 1 illustrates a block diagram depicting selected elements of an information handling system 100 in accordance with some embodiments of the present disclosure. In various embodiments, information handling system 100 may represent different types of portable information handling systems, such as, display devices, head mounted displays, head mount display systems, smart phones, tablet computers, notebook computers, media players, digital cameras, 2-in-1 tablet-laptop combination computers, and wireless organizers, or other types of portable information handling systems. In one or more embodiments, information handling system 100 may also represent other types of information handling systems, including desktop computers, server systems, controllers, and microcontroller units, among other types of information handling systems. Components of information handling system 100 may include, but are not limited to, a processor subsystem 120, which may comprise one or more processors, and system bus 121 that communicatively couples various system components to processor subsystem 120 including, for example, a memory subsystem 130, an I/O subsystem 140, a local storage resource 150, and a network interface 160. System bus 121 may represent a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

As depicted in FIG. 1, processor subsystem 120 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data. In some embodiments, processor subsystem 120 may interpret and/or execute program instructions and/or process data stored locally (e.g., in memory subsystem 130 and/or another component of information handling system). In the same or alternative embodiments, processor subsystem 120 may interpret and/or execute program instructions and/or process data stored remotely (e.g., in network storage resource 170).

Also in FIG. 1, memory subsystem 130 may comprise a system, device, or apparatus operable to retain and/or retrieve program instructions and/or data for a period of time (e.g., computer-readable media). Memory subsystem 130 may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as system 100, is powered down.

In information handling system 100, I/O subsystem 140 may comprise a system, device, or apparatus generally operable to receive and/or transmit data to/from/within information handling system 100. I/O subsystem 140 may represent, for example, a variety of communication interfaces, graphics interfaces, video interfaces, user input interfaces, and/or peripheral interfaces. In various embodiments, I/O subsystem 140 may be used to support various peripheral devices, such as a touch panel, a display adapter, a keyboard, an accelerometer, a touch pad, a gyroscope, an IR sensor, a microphone, a sensor, or a camera, or another type of peripheral device.

Local storage resource 150 may comprise computer-readable media (e.g., hard disk drive, floppy disk drive, CD-ROM, and/or other type of rotating storage media, flash memory, EEPROM, and/or another type of solid state storage media) and may be generally operable to store instructions and/or data. Likewise, the network storage resource may comprise computer-readable media (e.g., hard disk drive, floppy disk drive, CD-ROM, and/or other type of rotating storage media, flash memory, EEPROM, and/or other type of solid state storage media) and may be generally operable to store instructions and/or data.

In FIG. 1, network interface 160 may be a suitable system, apparatus, or device operable to serve as an interface between information handling system 100 and a network 110. Network interface 160 may enable information handling system 100 to communicate over network 110 using a suitable transmission protocol and/or standard, including, but not limited to, transmission protocols and/or standards enumerated below with respect to the discussion of network 110. In some embodiments, network interface 160 may be communicatively coupled via network 110 to a network storage resource 170. Network 110 may be a public network or a private (e.g. corporate) network. The network may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and/or messages (generally referred to as data). Network interface 160 may enable wired and/or wireless communications (e.g., NFC or Bluetooth) to and/or from information handling system 100.

In particular embodiments, network 110 may include one or more routers for routing data between client information handling systems 100 and server information handling systems 100. A device (e.g., a client information handling system 100 or a server information handling system 100) on network 110 may be addressed by a corresponding network address including, for example, an Internet protocol (IP) address, an Internet name, a Windows Internet name service (WINS) name, a domain name or other system name. In particular embodiments, network 110 may include one or more logical groupings of network devices such as, for example, one or more sites (e.g. customer sites) or subnets. As an example, a corporate network may include potentially thousands of offices or branches, each with its own subnet (or multiple subnets) having many devices. One or more client information handling systems 100 may communicate with one or more server information handling systems 100 via any suitable connection including, for example, a modem connection, a LAN connection including the Ethernet or a broadband WAN connection including DSL, Cable, Ti, T3, Fiber Optics, Wi-Fi, or a mobile network connection including GSM, GPRS, 3G, or WiMax.

Network 110 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. Network 110 and its various components may be implemented using hardware, software, or any combination thereof.

Turning now to FIG. 2, FIG. 2 illustrates an information handling system (IHS) 200 for mitigating blue-light exposure to a user. Specifically, the IHS 200 can include a blue-light mitigation computing module 202, an environmental sensor 204, a camera module 206, and a display device 208. The blue-light mitigation computing module 202 can be in communication with the environmental sensor 204, the camera module 206, and the display device 208. The IHS 200 can be similar to the information handling system 100 of FIG. 1. In short the IHS 200, and in particular, the blue-light mitigation computing module 202, can provide a contextual model for processing of a variety of inputs to determine an exposure to the user 210 of blue-energy emission from the display device 208, described further herein. The IHS 200 can be located within an environment 280, e.g., an office, room, or other environment.

In some implementations, the display device 208 can provide for display one or more images 222. The blue-light mitigation computing module 202 can determine, for each image 222, a blue-light energy output level 282 of the image 222. In short, the blue-light mitigation computing module 202 can decompose each image 222 (or frame 222) to determine an amount of blue-light energy output 282 of the image 222. In some examples, the blue-light mitigation computing module 202 can utilize a linear histogram to determine the blue-light energy output level 282 of each image 222. Specifically, the blue-light mitigation computing module 202 applies the linear histogram to a center of each image 222 and determines a frequency (color) ratio between blue, green, and red frequencies (e.g., the energy output of the image 222 is approximately 20% blue-light energy). The blue-light mitigation computing module 202 can apply a weighting factor to the total energy output by each image 222 based on the color ratio to determine the blue-light energy output level 282 of each image 222. The blue-light mitigation computing module 202 can determine the total energy emitted per second over a frequency range by integrating over the frequency range. The blue-light mitigation computing module 202 can add discrete ranges together if more than one frequency range is desired at once. The blue-light mitigation computing module 202 can accumulate the blue-light energy output 282 for each of the images 222 to provide the total blue-light energy output level 282 of the images 222.

In some examples, the blue-light mitigation computing module 202 can measure the blue-light energy output level 282 of each image 222 quantitatively. Specifically, the blue-light mitigation computing module 202 can measure the blue-light energy output level 282 of each image 222 using an average approach of the entirety image 222 or a localized approach wherein the image 222 is divided into multiple portions to more accurately represent the image 222.

In some implementations, the environmental sensor 204 can determine an environmental illumination brightness level 284 of the environment 280 surrounding the IHS 200. In particular, the environmental sensor 204 can include an ambient light sensor (ALS) that can determine the ambient illumination level 284 of the environment 280. The environmental sensor 204 can provide data that indicates the environmental illumination brightness level 284 of the environment 280 to the blue-light mitigation computing module 202. In some examples, a default value of the environmental illumination brightness level 284 can be provided to the blue-light mitigation computing module 202.

In some implementations, the environmental sensor 204 can determine an environmental illumination white color point 286 of the environment 280 surrounding the IHS 200. In particular, the environmental sensor 204 can include the ALS and a color sensor that can determine the color temperature of the environment 280. The environmental sensor 204 can provide data that indicates the environmental illumination white color point 286 of the environment 280 to the blue-light mitigation computing module 202. In some examples, a default value of the environmental illumination white color point 286 can be provided to the blue-light mitigation computing module 202.

In some implementations, the camera module 206 can determine a distance of the user 210 with respect to the display device 208. Specifically, the camera module 206 can monitor the location of the user 210, including a view distance to the screen of the display device 208 and viewing angle location with respect to the display device 208. The camera module 206 can provide data 287 indicating the distance of the user 210 with respect to the display 208 to the blue-light mitigation computing module 202. In some examples, the distance of the user 210 with respect to the display device 208 can be 18 inches (e.g., when the IHS 200 is a laptop computing device), 22 inches (e.g., when the IHS 200 is a desktop computing device), or 16 inches (e.g., when the IHS 200 is a smartphone computing device).

In some implementations, the blue-light mitigation computing module 202 can determine an exposure time 288 of the user 210 to the blue-light energy, e.g., an accumulative time to exposure of the blue-light energy. In some examples, the camera module 206 can determine the time-to-view screen of the display device 208, and provide such data to the blue-light mitigation computing module 202.

In some implementations, the blue-light mitigation computing module 202 can generate a (contextual) model 290 of the blue-light energy exposure of the user 210. Specifically, the blue-light mitigation computing module 202 can generate the model 290 of the blue-light energy exposure of the user 210 based on a combination of one or more of i) the blue-light energy output level 282 of each of the images 222, ii) the environmental illumination brightness level 284, iii) the environmental illumination white color point 286, iv) the distance 287 of the user 210, and v) the user exposure time 288. In some examples, the model 290 is based on a summation of values of i) the blue-light energy output level 282 of each of the images 222, ii) the environmental illumination brightness level 284, iii) the environmental illumination white color point 286, and iv) the distance 287 of the user 210. In some examples, the summation of the aforementioned values is scaled based on the user exposure time 288—that is, the summation of i) the blue-light energy output level 282 of each of the images 222, ii) the environmental illumination brightness level 284, iii) the environmental illumination white color point 286, and iv) the distance 287 of the user 210 is multiplied by the user exposure time 288.

In some implementations, the blue-light mitigation computing module 202 can determine, based on the model 290, that a current blue-light energy exposure of the user 210 with respect to the display device 208 is greater than a threshold. In response, the blue-light mitigation computing module 202 can perform an action 292 to mitigate the blue-light energy exposure of the user 210.

For example, the blue-light mitigation computing module 202 can determine, based on the model 290, that the current blue-light energy exposure of the user 210 is less than a first threshold. In response to the current blue-light energy exposure of the user 210 is less than the first threshold, the blue-light mitigation computing module 202 preforms no action.

For example, the blue-light mitigation computing module 202 can determine, based on the model 290, that the current blue-light energy exposure of the user 210 is greater than the first threshold but less than a second threshold. In response to the current blue-light energy exposure of the user 210 being greater than the first threshold but less than a second threshold, the blue-light mitigation computing module 202 can provide a notification to the user 210 via the display device 208 of the blue-light energy exposure. For example, the notification can inform the user 210 to take a break for a certain period of time.

For example, the blue-light mitigation computing module 202 can determine, based on the model 290, that the current blue-light energy exposure of the user 210 is greater than the second threshold. In response to the current blue-light energy exposure of the user 210 being greater than the second threshold, the blue-light mitigation computing module 202 can i) reduce the display brightness level of the display device 208 and/or ii) reduce the white color point of the display device 208. In response to the current blue-light energy exposure of the user 210 being greater than the second threshold, the blue-light mitigation computing module 202 can perform a shut-down operation of the IHS 200.

In some examples, the blue-light mitigation computing module 202 adjusts a display brightness level of the display device 208 based on the environmental illumination brightness level 284. Specifically, the blue-light mitigation computing module 202 can adjust the display brightness level of the display device 208 to match the environmental illumination brightness level 284. For example, if the environmental illumination brightness level 284 is lower than the display brightness level of the display device 208, the blue-light mitigation computing module 202 can lower the brightness level of the display device 208. In some examples, the blue-light mitigation computing module 202 adjusts a white color point of the display device 208 based on the environmental illumination white color point 286. Specifically, the blue-light mitigation computing module 202 can adjust the white color point of the display device 208 to match the enviromental illumination white color point 286.

In some examples, the accumulation of the blue-light energy by the user 210 can be linear or exponential. In some examples, when the user 210 ceases to be exposed to the blue-light energy (e.g., the user 210 steps away from the display device 208 or the IHS 200 is shut down) the blue-light energy exposure of the user 210 can decrease. For example, the blue-light energy exposure of the user 210 can decay linearly or exponentially. The energy decay can be tracked by a timer computing module (not shown) such that the user 210 will not re-engage until the energy decay is below a particular threshold (e.g., the first or the second threshold). In some examples, the user 210 can be again exposed to the blue-light energy at a later time (e.g., the user 210 returns to the display device 208). The blue-light mitigation computing module 202 can re-determine a blue-light energy exposure of the user 210 with respect to the display device 208 based on the previous exposure to the blue-light energy and the current blue-light energy exposure (e.g., an updated blue-light energy exposure as a summation of the previous exposure to the blue-light energy and the current blue-light energy exposure). The blue-light mitigation computing module 202 can compare the updated blue-light energy exposure to the aforementioned thresholds, and mitigate the blue-light exposure to the user 110, similar to that mentioned above. In some examples, the user 210 can be again exposed to the blue-light energy at a later time on a different computing device than IHS 200 (e.g., blue-light exposure across multiple, differing computing devices).

FIG. 3 illustrates a flowchart depicting selected elements of an embodiment of a method 300 for mitigating blue-light exposure to a user. The method 300 may be performed by the information handling system 100, the IHS 200, and/or blue-light mitigation computing module 202 described herein with reference to FIGS. 1-2, or another information handling system. It is noted that certain operations described in method 200 may be optional or may be rearranged in different embodiments.

Images 222 are provided for display on the display device 208 of the IHS 200 (302). The blue-light mitigation computing module 202 determines, for each image 222, the blue-light energy output level 282 of the image 222 (304). The environmental sensor 204 determines the environmental illumination brightness level 284 of the environment 280 surrounding the IHS 200 (306). The environmental sensor 204 can provide data indicating the environmental illumination brightness level 284 to the blue-light mitigation computing module 202. The environmental sensor 204 determines the environmental illumination white color point 286 of the environmental 280 surrounding the IHS 200 (308). The environmental sensor 204 can provide data indicating the environmental illumination white color point 286 to the blue-light mitigation computing module 202. The camera module 206 can determine the distance of the user 210 of the IHS 200 with respect to the display device 208 of the IHS 200 (310). The camera module 206 can provide distance data 287 to the blue-light mitigation computing module 202. The camera module 206 and/or the blue-light mitigation computing module 202 can determine an user exposure time 288 to the blue-light energy output from the IHS 200 (312). The blue-light mitigation computing module 202 generates the model 290 of blue-light energy exposure based on the i) the blue-light energy output level 282 of each image 222, ii) the environmental illumination brightness level 284, iii) the environmental illumination white color point 286, iv) the distance 287 of the user, and v) the user exposure time 28 (314). The blue-light mitigation computing module 202 determines, based on the model 290 that a current blue-light energy exposure of the user 210 with respect to the display device 208 is above a threshold (316). The blue-light mitigation computing module 202, in response to determining that the current blue-light energy exposure of the user 210 with respect to the display device 208 is above the threshold, performs, the action 292 to mitigate the blue-light energy exposure of the user 210 (318).

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated other-wise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, features, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A computer-implemented method, comprising:

providing, for display on a display device of an information handling system (IHS), one or more images;

determining, for each image of the one or more images, a blue-light energy output level of the image;

determining an environmental illumination brightness level of an environment surrounding the IHS;

determining an environmental illumination white color point of the environment surrounding the IHS;

determining a distance of a user of the IHS with respect to the display device of the IHS;

determining an user exposure time to the blue-light energy output from the IHS;

generating, by a blue-light mitigation computing module, a model of blue-light energy exposure based on the i)

the blue-light energy output level of each image, ii) the environmental illumination brightness level, iii) the environmental illumination white color point, iv) the distance of the user, and v) the user exposure time;

determining, by the blue-light mitigation computing module and based on the model, that a current blue-light energy exposure of the user with respect to the display device is above a threshold; and in response to determining that the current blue-light energy exposure of the user with respect to the display device is above the threshold, performing, by the blue-light mitigation computing module, an action to mitigate the blue-light energy exposure of the user.

2. The computer-implemented method of claim 1, wherein determining, for each image of the one or more images, the blue-light energy output level of the image includes utilizing a linear histogram to determine the blue-light energy output level of each image of the one or more images.

3. The computer-implemented method of claim 1, further comprising adjusting a display brightness level of the display device based on the environmental illumination brightness level.

4. The computer-implemented method of claim 3, wherein adjusting the display brightness level of the display device further includes adjusting the display brightness level of the display device to match the environment illumination brightness level.

5. The computer-implemented method of claim 1, further comprising adjusting a white color point of the display device based on the environmental illumination white color point.

6. The computer-implemented method of claim 1, wherein adjusting the white color point of the display device further includes adjusting the white color point of the display device to match the environmental illumination white color point.

7. The computer-implemented method of claim 1, wherein performing the action to mitigate the blue-light energy exposure of the user includes providing a notification to the user via the display device of the blue-light energy exposure.

8. The computer-implemented method of claim 1, wherein performing the action to mitigate the blue-light energy exposure of the user includes i) reducing a display brightness level of the display device and ii) reducing a white color point of the display device.

9. The computer-implemented method of claim 1, wherein performing the action to mitigate the blue-light energy exposure of the user includes performing a shut-down operation of the IHS.

10. An information handling system (IHS), comprising:

a display device providing for display one or more images;

an environmental sensor to determine the environmental illumination brightness level of an environment surrounding the IHS, and the environmental illumination white color point of the environment surrounding the IHS;

a camera module to determine a distance of a user of the IHS with respect to the display device of the IHS;

a blue-light mitigation computing module configured to:

determine, for each image of the one or more images, a blue-light energy output level of the image;

determine an user exposure time to the blue-light energy output from the IHS;

generate a model of a blue-light energy exposure based on the i) the blue-light energy output level of each image, ii) the environmental illumination brightness level, iii) the environmental illumination white color point, iv) the distance of the user, and v) the user exposure time;

determine, based on the model, that a current blue-light energy exposure of the user with respect to the display device is above a threshold; and in response to determining that the current blue-light energy exposure of the user with respect to the display device is above the threshold, perform an action to mitigate the blue-light energy exposure of the user.

11. The information handling system of claim 10, wherein determining, for each image of the one or more images, the blue-light energy output level of the image includes utilizing a linear histogram to determine the blue-light energy output level of each image of the one or more images.

12. The information handling system of claim 10, the operations further comprising adjusting a display brightness level of the display device based on the environmental illumination brightness level.

13. The information handling system of claim 12, wherein adjusting the display brightness level of the display device further includes adjusting the display brightness level of the display device to match the environment illumination brightness level.

14. The information handling system of claim 10, the operations further comprising adjusting a white color point of the display device based on the environmental illumination white color point.

15. The information handling system of claim 10, wherein adjusting the white color point of the display device further includes adjusting the white color point of the display device to match the environmental illumination white color point.

16. The information handling system of claim 10, wherein performing the action to mitigate the blue-light energy exposure of the user includes providing a notification to the user via the display device of the blue-light energy exposure.

17. The information handling system of claim 10, wherein performing the action to mitigate the blue-light energy exposure of the user includes i) reducing a display brightness level of the display device and ii) reducing a white color point of the display device.

18. The information handling system of claim 10, wherein performing the action to mitigate the blue-light energy exposure of the user includes performing a shut-down operation of the IHS.

19. A non-transitory computer-readable medium storing software comprising instructions executable by one or more computers which, upon such execution, cause the one or more computers to perform operations comprising:

providing, for display on a display device of an information handling system (IHS), one or more images;

determining, for each image of the one or more images, a blue-light energy output level of the image;

determining an environmental illumination brightness level of an environment surrounding the IHS;

determining an environmental illumination white color point of the environment surrounding the IHS;

determining a distance of a user of the IHS with respect to the display device of the IHS;

determining an user exposure time to the blue-light energy output from the IHS;

generating a model of blue-light energy exposure based on the i) the blue-light energy output level of each image, ii) the environmental illumination brightness level, iii) the environmental illumination white color point, iv) the distance of the user, and v) the user exposure time;

determining, based on the model, that a current blue-light energy exposure of the user with respect to the display device is above a threshold; and in response to determining that the current blue-light energy exposure of the user with respect to the display device is above the threshold, performing an action to mitigate the blue-light energy exposure of the user.

20. The non-transitory computer-readable medium of claim 19, wherein determining, for each image of the one or more images, the blue-light energy output level of the image includes utilizing a linear histogram to determine the blue-light energy output level of each image of the one or more images.

* * * * *